United States Patent [19]

Wright

[11] 4,002,035

[45] Jan. 11, 1977

[54] MOBILE SHORING RIG FOR EXCAVATION OF TRENCHES

[76] Inventor: Charles V. Wright, 54 Oak Hollow Road, Springfield, Mass. 01128

[22] Filed: July 11, 1975

[21] Appl. No.: 595,366

[52] U.S. Cl. ..... 61/41 A; 61/106

[51] Int. Cl.[2] ..... E02D 19/00

[58] Field of Search ..... 61/41 A, 72.1, 72.5, 61/72.7, 41; 37/80

[56] References Cited

UNITED STATES PATENTS

| | | | |
|---|---|---|---|
| 1,267,058 | 5/1918 | Clarkson | 61/41 A |
| 3,159,978 | 12/1964 | DeLillo | 61/41 A |
| 3,788,086 | 1/1974 | West, Jr. | 61/41 A |

*Primary Examiner*—Jacob Shapiro

*Attorney, Agent, or Firm*—Chapin, Neal and Dempsey

[57] ABSTRACT

Mobile shoring rig to be used during excavation of trenches for laying underground pipe of varying diameter, includes a self-propelled carrier movable at ground level straddling the margins of the trench. A shoring frame supported within the carrier is vertically movable relative to the carrier for raising and lowering the frame into the trench being straddled by the carrier. The shoring frame includes a plurality of individual sheets or plates carried by a frame which are vertically movable with and relative to the frame on a plurality of longitudinally spaced guideways. The plates are of varying width to span one or more of the longitudinally spaced guideways and are slidable thereon for vertical movement together with and independently of the shoring frame.

5 Claims, 9 Drawing Figures

10
12
16
18
20
22
24
26
27
30
32
36
38
50
52
54
55
60
62
70
74
4
5

10
12
14
16
22
24
26
27
28
30
32
34
36
38
40
42
43
50
52
56
62
64
68
70
5
7

MOBILE SHORING RIG FOR EXCAVATION OF TRENCHES

BACKGROUND

In excavating trenches for laying large diameter pipe, it is necessary to provide safety for workmen who must enter the trench and support for adjacent utilities during the excavation. Such trenches may vary in depth up to 22 feet and in width from about 6 to 14 feet to accommodate pipe of diameters from 15 to 120 inches. Trench shoring has generally been provided in the past by the use of pilings with sheathing in place outside the pilings and cross beams disposed transversely of the trench line. Construction of such shoring arrangements generally slows the excavation and involves substantial expenditures and labor not directly related to the excavating work itself.

In recent years there have been a number of proposed shoring boxes and cages prefabricated for ready installation into the trench excavation. Such arrangements, however, have not been entirely self-propelled and adjustable to accommodate trenches of varying width and depth and in which the shoring plates or sheathing are movable with a shoring frame which can be raised and lowered into and out of the trench relative to a self-propelled carrier and in which the plates are individually movable relative to the frame.

It is the principal object of this invention to provide an improved self-propelled shoring rig for use in trench excavation of improved versatility and operating efficiency.

The above and other objects of the invention will be more readily apparent from a reading of the following description and with reference to the accompanying drawings, in which.

Figures 1, 4, 5:
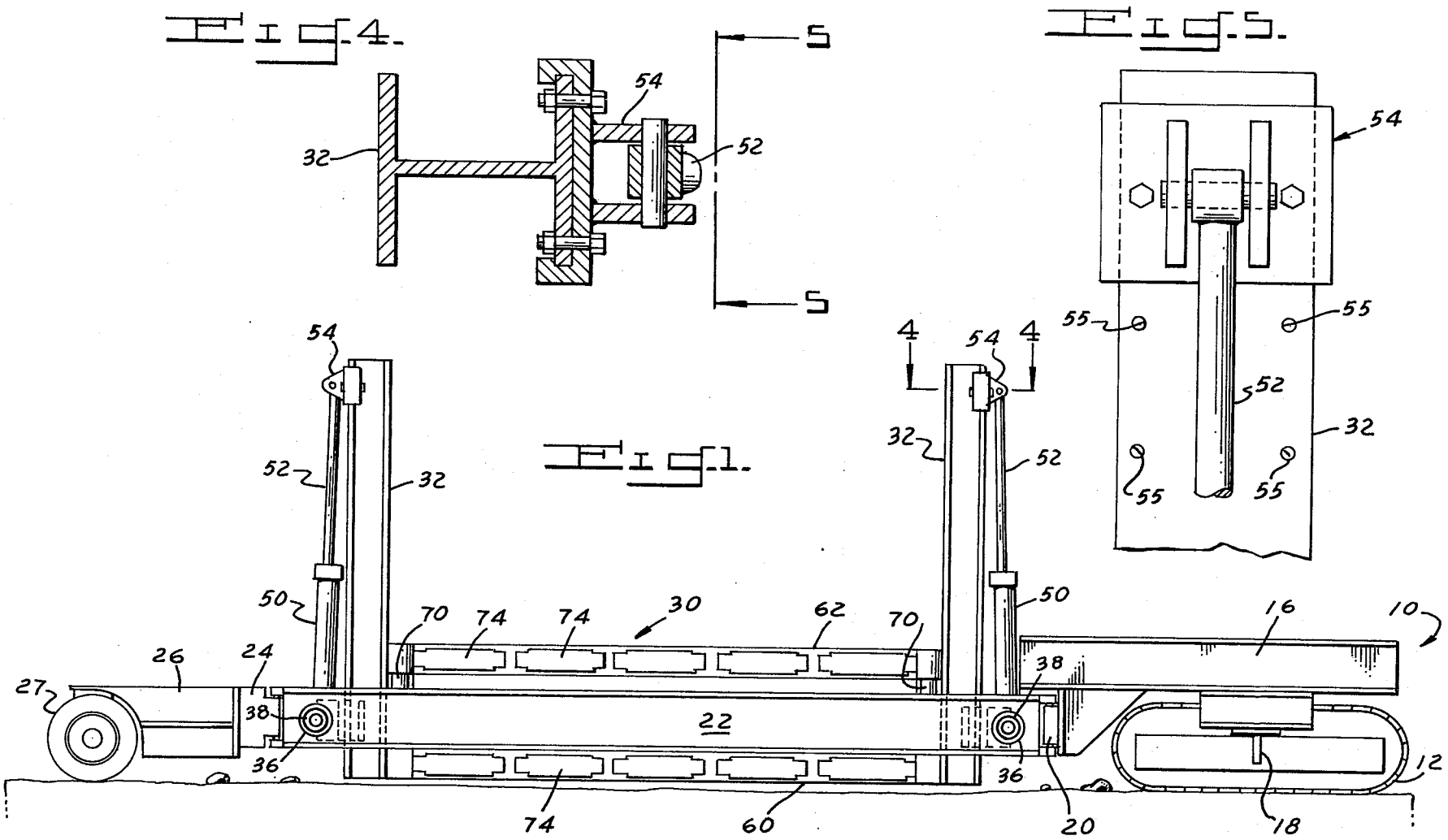
FIG. 1 is an elevational view of a self-propelled shoring rig of the type embodying my invention.
FIG. 4 is a cross sectional view on an enlarged scale taken along the line 4—4 of FIG. 1.
FIG. 5 is a view taken along line 5—5 of FIG. 4.
Figure 2:
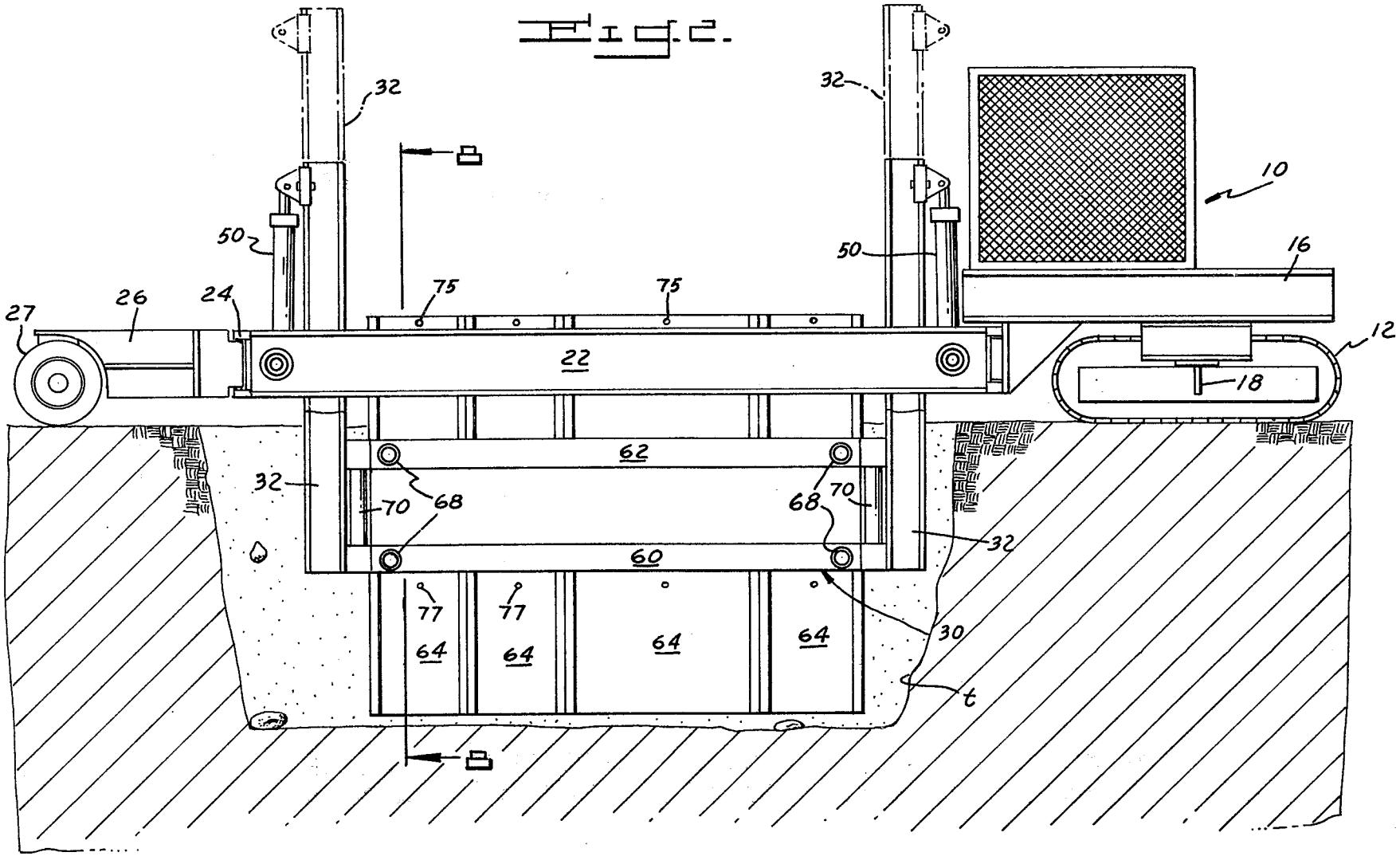
FIG. 2 is an elevational view similar to FIG. 1, in which the rig is shown in operative condition within an excavation.

Referring in detail to the drawings, FIGS. 1 and 2 show a self-propelled track vehicle, indicated generally at 10. The vehicle includes two laterally spaced drive or conveyancing means 12 and 14. As shown, each takes the form of a tractor tread vehicle which pivotably supports a longitudinally extending beam 16 affixed to a frame pivotable on a king pin arrangement indicated at 18. The after end of each beam 16 is connected by a pivot pin coupling shown generally at 20 to the front end of the I beam 22. The opposite end of each I beam 22 is provided with a suitable pivot or king pin coupling 24 connected to the frame or chassis of a wheeled conveyancing means 26. The chassis of the conveyancing vehicle is pivotably connected to the axle or hub of each wheel 27. The two side frames or beams 22 are connected transversely by means of struts 28 to form a generally rectangular mobile carrier. The struts 28 include cylindrical tubular members 36 attached to the beams 22 adjacent opposite ends thereof and a rod 38 telescopically fitted into the members 36 for adjusting the distance between the side frames 22 for trenches of different width. Hydraulic means, such as the cylinder and rod assembly 37, is provided at each strut to increase or decrease the spacing between the beams 22. Lock pins 40 are further provided for use with a plurality of radially extending holes for securely locking the struts in a selected position. In addition, at each corner of the carrier, the conveyancing means, track or wheels, are capable of being directed inwardly or outwardly from the axis of the beams 22. Thus, the track and wheeled conveyancing means may move along a line parallel to but offset from the axis of the beams as is illustrated by the dotted line showing in FIG. 3.

Thus, the carrier with its four conveyancing means and longitudinally extending side beams, provides the means to carry a shoring box or frame disposed therewithin along the outer margins of a trench being excavated by a suitable earth mover, such as a backhoe or the like. The shoring frame or box is shown generally at 30 in FIGS. 1 and 2. The frame is carried between the two side beams 22 of the carrier and lift means is provided by four upright beams or stanchions 32, one being located at each of the four corners of the generally rectangular shoring box. As shown, the stanchions 32 take the form of steel I beams slidably supported in a guideway track affixed to a bracket 34, FIGS. 5 and 6. It extends outwardly of the fixed porition of the telescopically adjustable cross posts or struts 28.

Figures 3, 6, 7:
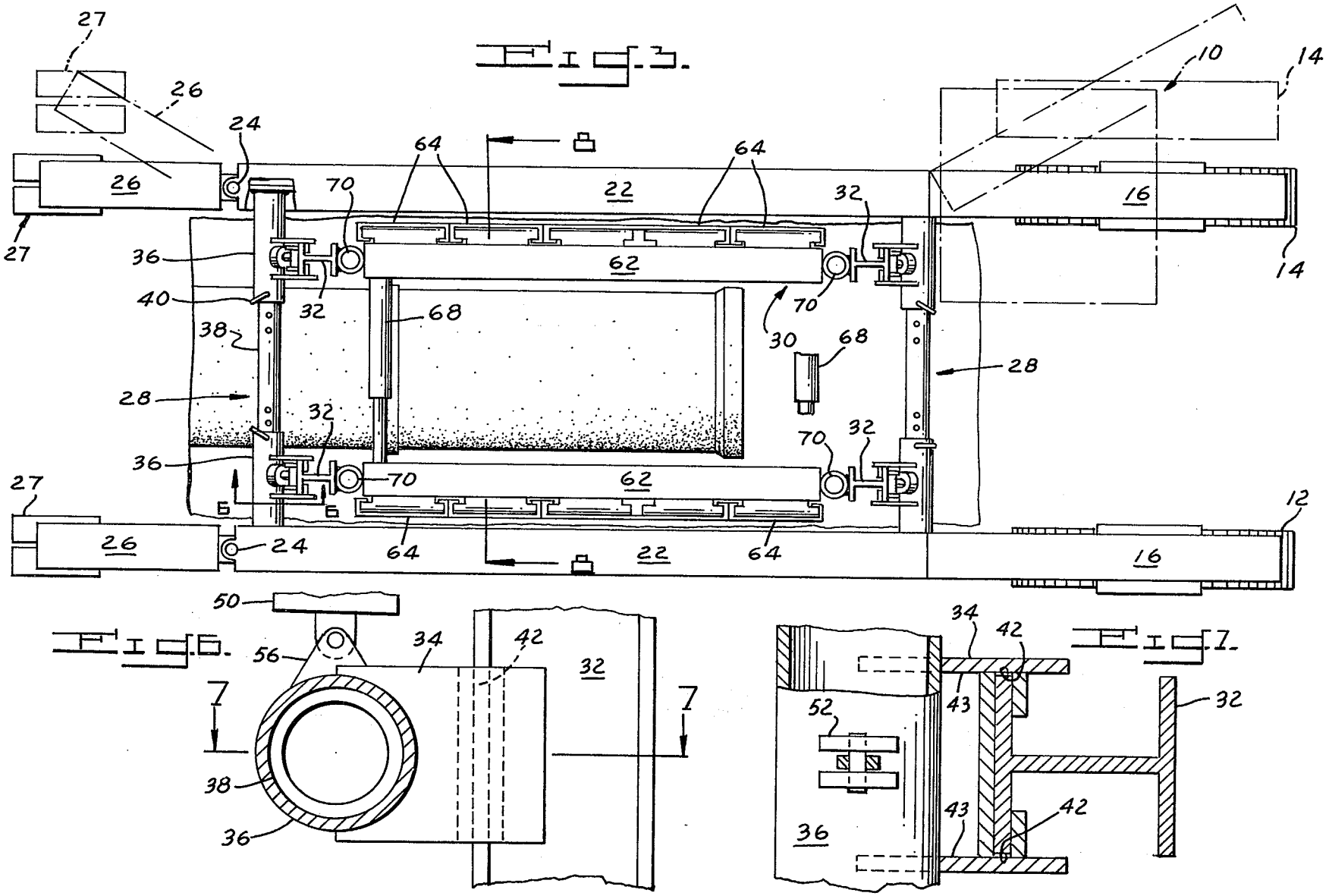
FIG. 3 is a plan view of the mobile shoring rig as shown in FIG. 2.
FIG. 6 is a cross sectional view on an enlarged scale taken along line 6—6 of FIG. 3.
FIG. 7 is a cross sectional view taken along the line 7—7 of FIG. 6.

The opposite side edges of one flange of each of the stanchions 32 are slidably disposed within opposed U-shaped slide channels 42, FIG. 7, provided between a pair of spaced plates 43 which extend radially from the fixed portion 36 of strut 28.

Hydraulic means is provided for raising and lowering each stanchion 32 and comprises a cylinder 50 and piston rod 52, one of which is affixed to a vertically adjustable bracket 54 bolted adjacent the upper end of each stanchion, the other being pivotably connected to a bracket 56, FIG. 6, connected to the strut 28. A plurality of vertically spaced bolt holes are provided through one flange of each stanchion 32 which permits vertical adjustment of the bracket 54 on the stanchion. In this way the length of vertical travel of the stanchions is adjustable for different conditions. Hydraulic pressure applied to each cylinder may be controlled by suitable means, not shown, to raise and lower each stanchion either individually or simultaneously, whereby the height of the shoring frame 30 will be controlled. The shoring frame is affixed to the lower end portion of the stanchion 32.

The shoring box 30 comprises two pairs of "whalers" or beams 60 which extend longitudinally from one end to the other of the shoring box adjacent the lower ends of the stanchions 32. A second pair of whalers or beams 62 extend longitudinally from the stanchions 32 at one end of the shoring box to the stanchions 32 at the other end of the box. The upper whalers are spaced above the lower whalers by a sufficient distance to provide stability for the vertically movable shoring plates 64, as will hereinafter be more fully described. A spacing between these two sets of beams of about five or six feet has been found to provide good vertical stability for the shoring plates. In addition, a length of about 30 feet for the shoring box has been found to provide very effective operation.

Figure 8:
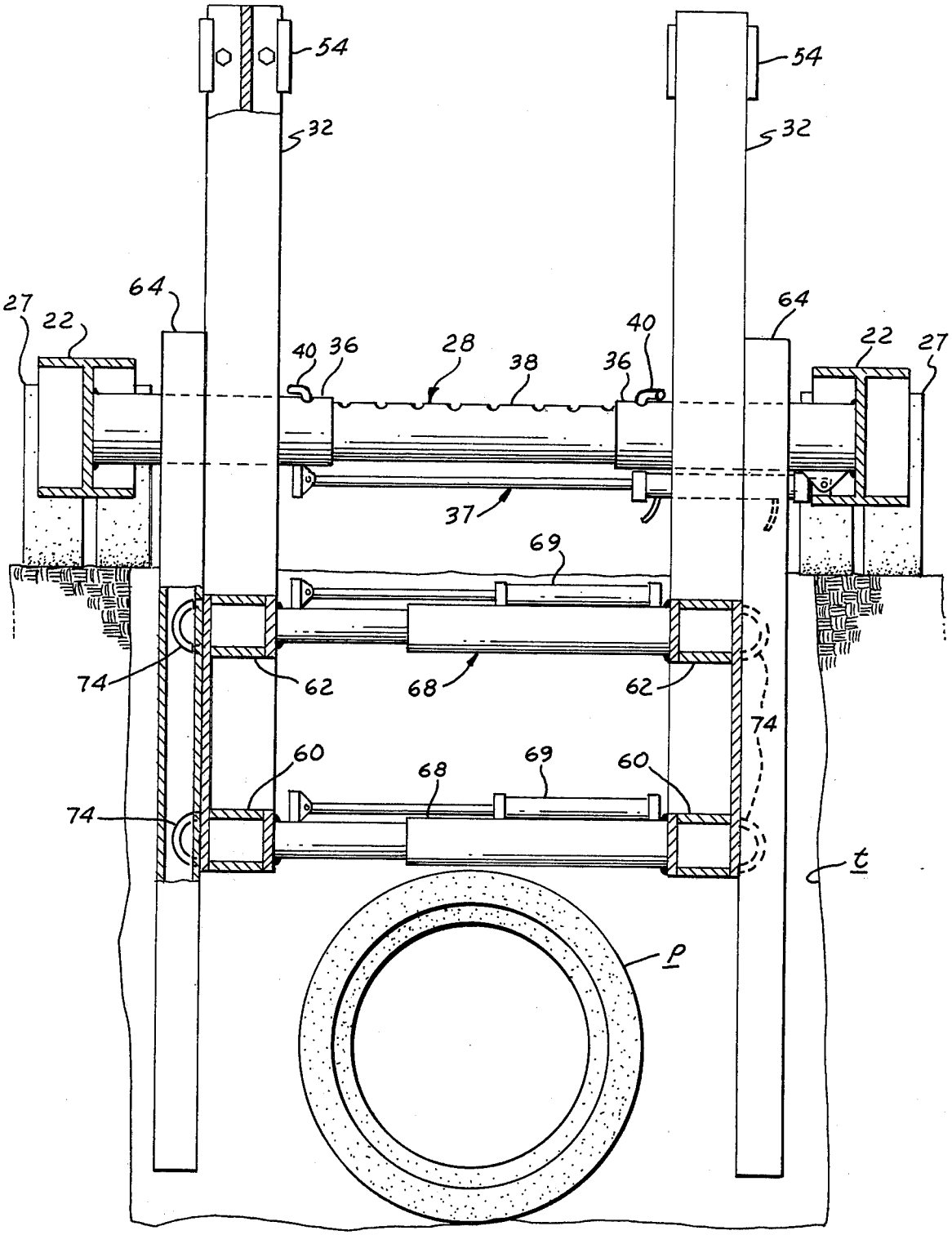
FIG. 8 is a cross sectional view on an enlarged scale taken along line 8—8 of FIG. 3.

In addition to the longitudinal beams 60 and 62 (FIGS. 2 and 8), the shoring box also includes at each end thereof a pair of telescopically adjustable upper and lower struts 68, one of which extends between the front and aft ends of each pair of beams 60 and 62. Each strut is provided with a hydraulic piston assmebly 69 (FIG. 8) to increase and decrease the length of the struts and thus the distance between the side beams 60 and 62 to accommodate trenches of different widths. For increased structural strength and rigidity a vertical post 70 may as shown be provided at each corner of the shoring box. The inner facing side of each post is fastened to the ends of the shoring box beams and the outer side to the stanchions 32.

Figure 9:
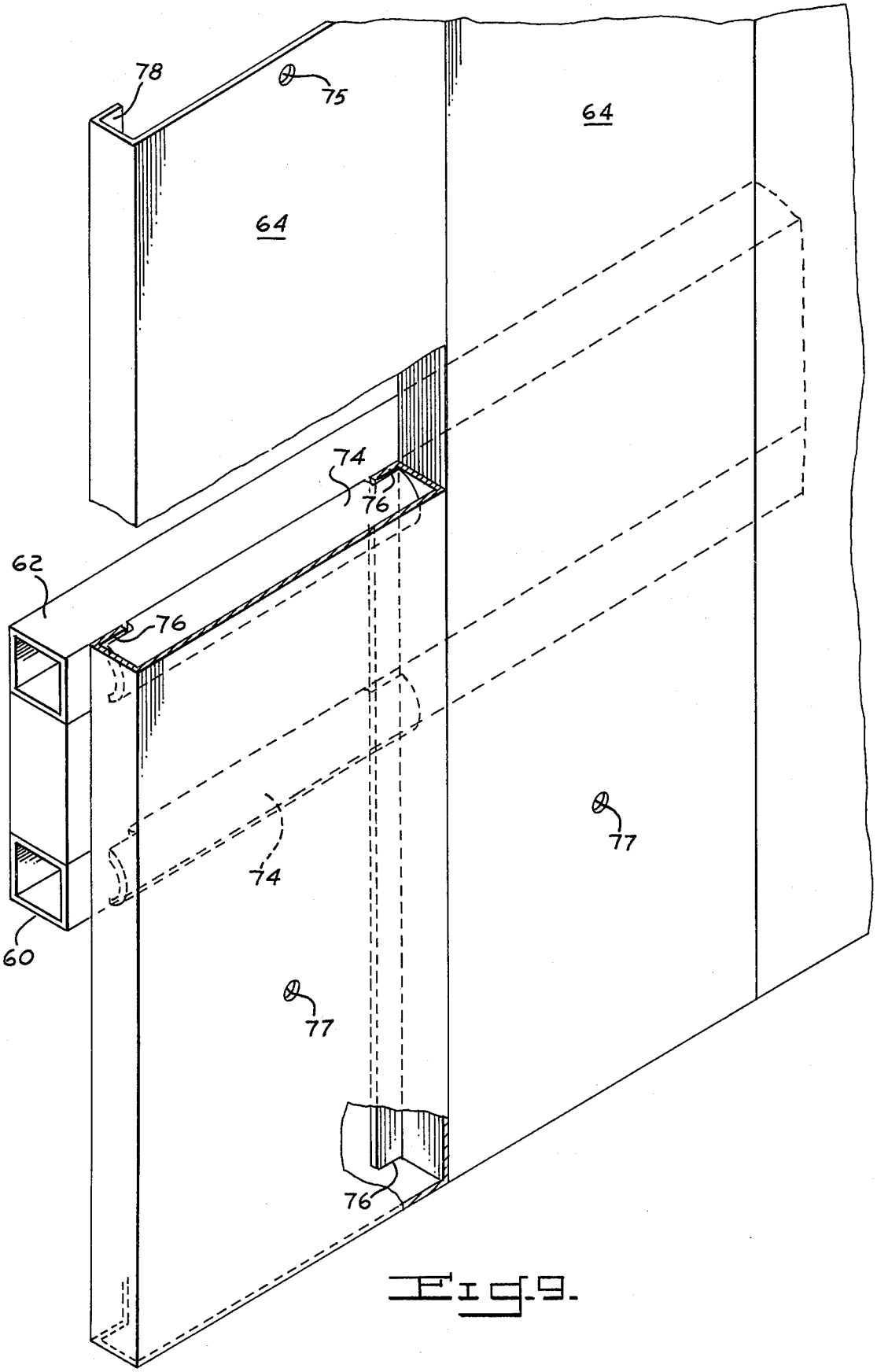
FIG. 9 is a partial perspective view on an enlarged scale showing the sheathing arrangement of the rig embodying my invention.

Slideways or guide channel retainers are provided along the outer surface of each of the whalers or beams 60 and 62. As shown, in FIGS. 3, 8 and 9, these slideway retainers take the form of a plurality of semi-cylindrical sections 74 by axially cutting in half a length of metal pipe of suitable diameter. Each retainer section extends longitudinally along the outer of the beams 60 and 62 and adjacent pairs are spaced apart in end-to-end relation with their convex cylindrical curved walls disposed outwardly of the beams. The straight outer edge portions of each section are undercut, as best shown at 76 in FIG. 9. The space defined by these undercut slots and the underlying outer surface of the whalers provide channels for receiving and slidably retaining the U-shaped or inturned end portions 78 of the shoring plate 64 for vertical sliding movement of the plates relative the shoring box. For assembly, the shoring plates are lowered from above the shoring frame so that their inturned flanges fit into the slots 76 and slide downwardly therein, first onto the upper beam retainers then into the lower beam retainers so that each plate is held firmly at vertically spaced points in an upright plane. A bearing surface for support of the shoring plates is also provided by the outer cylindrical surface of each pipe section 74 which provides for tangential sliding contact with the inner surface of each shoring plate. This configuration enables vertical sliding movement of the plates while at the smae time insuring that the plates will be firmly held in an upright plane, perpendicular to the plane defined by the upper surfaces of the shoring box frame.

In construction and operation, the showing plates and guideway retainers 74 are highly versatile. In this regard, each retainer section has a predetermined length. Whole number multiples of this length equals the widths of the various showing plate sizes provided with the rig. Each retainer section may, for example, have a length of three feet, while the shoring plate 64 may come in widths of three, six or nine feet, whereby one plate depending on the width selected, will span one, two or three retainer sections. This enables the operator to select different width plates for the particular conditions encountered in each excavation. Thus, where it becomes necessary to avoid an underground utility service line extending transversely of the trench line, a plate of the appropriate width may be selected. For example, a three foot plate may be omitted from the frame or may be left in a partially elevated position where a relatively narrow clearance is required for such a utility service line. In this way, maximum shoring protection will be afforded throughout the length of the shoring box.

Adjacent their upper ends, each plate 64 (FIG. 9) has a hole 75 by which a crane hook may be used to raise the plate until a second hole 77 is disposed above the bottom edge approximately the same distance as the height of the shoring box 30, is raised to a height above the beam 62. A suitable retaining pin may then be inserted into the hole 77, whereby the plates will be secured in their raised position with the lower ends thereof generally flush with the bottom of the beam 64. The shoring box, including sheathing plates 64, may be raised and lowered as a unit by using hydraulic pistons 50. Alternatively, each plate may be raised and lowered relative to the shoring box. When being propelled from place to place the lower beams 64 of the shoring box are positioned approximately flush with the undersurface of the beams 22 of the mobile carrier, as shown in FIG. 1.

In operation, the track drawn carrier is driven to the location where an excavation is to be dug. Each track vehicle is directed so as to provide the proper lateral spacing between the carrier beams 22 and at the same time various hydraulic means 37 and 69 (FIG. 8) are actuated in cooperation therewith so that the beams 22 are spaced to straddle the side walls of trench *t* while beams 60 and 62 are spaced apart somewhat less than the trench width t, whereby the shoring box may be lowered into the trench *t*. The trench may be dug by any suitable mechanical means, such as a backhoe to accommodate the diameter of the pipe *p* to be laid. As the excavation proceeds and before any workmen are permitted to enter the trench, the shoring box will be lowered into the trench by means of hydraulic pistons 50, as shown in FIG. 2. From this position, the shoring plates may be individually lowered in any convenient manner as by downward pressure by the shovel or scooop of the backhoe after removal of the retaining pins from holes 77. In FIG. 2, the shoring plates 64 are shown positioned in their trench shoring position. The workmen installing the pipe may then safely work within the protective confines of the shoring box between the plates 64 supported by beams 60 and 62 and transverse struts 68. After each pipe section is installed and coupled to the pipeline, the trench is back filled and the mobile shoring rig moved to the next section of the trench to be excavated. At any time during the use of the shoring box one or more individual sections or plates 64 may be raised or removed as necessary by simply inserting a hook from a boom into one of the holes 75 and applying an upward force. In this regard, for example, one plate may be raised to accommodate a utility service line which is encountered transversely of the trench line. Moreover, the entire shoring box, including its sheating plate 64 may be raised and lowered as a unit by actuation of hydraulic pistons 50. The multiple shoring unit of this invention may thus be used with remarkable ease and is characterized by unique versatility, total mobility and complete lateral adjustability for straddling excavations of various size.

Having thus described the invention, what is claimed is:

1. Mobile shoring for use in trench excavation comprising a carrier including a pair of laterally spaced longitudinally extending beams, beam support members, the opposite ends of each longitudinally extending beam being pivotably supported by one of said beam support members, conveyancing means including track vehicles, each beam support member being pivotably supported by one of said conveyancing means so that said conveyancing means may be swung outwardly and parallel to said longitudinally extending beams, a shoring frame supported by said carrier, said frame including longitudinally and transversely extending beam support members, means for raising and lowering said shoring frame relative to said carrier, a plurality of longitudinally and vertically spaced guide sections on the outer surface of the longitudinally extending beam support members of said shoring frame and a plurality of shoring plates vertically slidably retained by said guide sections, each of said plates spanning at least one of said vertically and longitudinally spaced pairs of guide sections and being vertically movable together with said frame and individually relative thereto.

2. Mobile shoring for trench excavation as set forth in claim 1 in which each guide section is of semi-cylindrical configuration with the convex curvature thereof disposed outwardly of the outer surface of said frame, the ends of each guide section being undercut to provide guideway slots defined by the undersurface of the cutout and the adjacent surface portion of the frame, each plate including an inwardly extending edge portion which slidably interfits with said slots whereby said plates are retained on said frame.

3. Mobile shoring for trench excavation as set forth in claim 2 in which said shoring plates are of generally planar configuration with opposed inturned side edge portions, the planar inner surface of said plates being disposed tangentially with the outer cylindrical surface of said guide sections.

4. Mobile shoring for trench excavation as set forth in claim 1 in which both said carrier and shoring frame include transversely extending strut members, the length of each strut member being adjustable to vary the lateral spacing between said longitudinally extending beams of the carrier and said beam support members of the shoring frame and hydraulic means for selectively increasing and decreasing the length of each strut member.

5. Mobile shoring for trench excavation as set forth in claim 1 in which each shoring plate has a width equal to a whole number multiple of the length of one of said guide sections, and said longitudinal beams of the carrier being pivotably supported by said vehicle conveyancing means.

* * * * *